United States Patent [19]

Penn

[11] 4,198,168

[45] Apr. 15, 1980

[54] PHASE BLENDING STATIC MIXING PROCESS AND APPARATUS

[75] Inventor: Laurence R. Penn, Kettering, England

[73] Assignee: Liquid Control Incorporated, Silver Spring, Md.

[21] Appl. No.: 896,017

[22] Filed: Apr. 12, 1978

[51] Int. Cl.[2] ..... B01F 13/00

[52] U.S. Cl. ..... 366/336; 366/348

[58] Field of Search ..... 366/336, 337, 338, 339, 366/340, 348; 138/38, 42

[56] References Cited

U.S. PATENT DOCUMENTS

| | | | |
|---|---|---|---|
| 3,182,965 | 5/1965 | Sluijters | 366/340 |
| 3,195,865 | 7/1965 | Harder | 366/337 |
| 3,286,992 | 11/1966 | Armeniades et al. | 366/339 |
| 3,394,924 | 7/1968 | Harder | 366/338 |
| 3,404,869 | 10/1968 | Harder | 366/338 |
| 3,406,947 | 10/1968 | Harder | 366/337 |
| 3,424,437 | 1/1969 | Shearer | 366/339 |
| 3,427,002 | 2/1969 | Wilding | 366/336 |
| 3,583,678 | 6/1971 | Harder | 366/340 |
| 3,857,551 | 12/1974 | Troy | 366/336 |

*Primary Examiner*—Stanley N. Gilreath
*Attorney, Agent, or Firm*—Wenderoth, Lind & Ponack

[57] ABSTRACT

A fluid stream including separate layers of plural components is mixed by dividing the fluid stream into a plurality of substreams, reorienting and recombining the substreams in a chamber, and repeating the steps of dividing, reorienting and recombining until a desired degree of mixing of the components is obtained. The substreams of a given stage or group of substreams are controlled so that the substreams are longitudinally dephased with respect to each other such that the fluids of the substreams are longitudinally blended when recombined. The dephasing is achieved by providing that at least selected of the passageways for the substreams of a given stage of the mixer are dimensioned such that the total resistances to flow of the fluid of the substreams passing through the selected passageways, from the beginnings thereof to the ends thereof, are unequal. Such differing total flow resistances may be achieved by providing selected of the passageways with unequal cross-sectional areas, or alternatively with unequal lengths.

7 Claims, 6 Drawing Figures

PHASE BLENDING STATIC MIXING PROCESS AND APPARATUS

BACKGROUND OF THE INVENTION

The present invention relates to an improved process and apparatus for statically mixing layers of separate fluid components. More particularly, the present invention relates to improvements in such static mixing by use of mixers of the interfacial surface generator type.

The use of static or motionless mixers of the interfacial surface generator type is well known for the mixing of two or more streams of fluids, particularly viscous liquids, whereby the fluids are driven in proportion through an interfacial surface generator which mixes the fluids. This mixing is achieved by division of an inlet fluid stream containing layers of each of the fluids into a plurality of substreams, then reorienting and recombining the substreams into a main stream, and then repeating such division, reorientation and recombination until a desired degree of mixing of the fluid components is achieved.

Examples of such static or motionless mixer systems of the interfacial surface generator type are shown in U.S. Pat. No. 3,182,965, No. 3,195,865, No. 3,286,992, No. 3,394,924, No. 3,404,869, No. 3,406,947, No. 3,424,437 and No. 3,583,678. Such known static or motionless mixers have greater simplicity, almost zero heat input, and have no moving parts, as compared to more conventional dynamic mechanical mixers.

Such static mixers were originally developed for the "in-line" mixing of chemicals where continuous flow maintains the desired proportion of the components taken at any cross-sectional area of the mixer, and such mixers are conventionally designed to maintain such given proportion throughout the mixer.

However, such continuous and proportional operation is very difficult to achieve under actual operating conditions. That is, it is difficult to actually achieve completely continuous flow of all components to the inlet of an interfacial surface generator. Rather, what normally occurs is that the supply of one of the components will be temporarily interrupted, with the result that the stream which is supplied to the interfacial surface generator includes periodic solid patches or spots of only one of the components. Such discontinuous supply may be caused due to the pulsation of the pumps employed to supply the components. Such discontinuous supply is unavoidable when the components are supplied when discharging shot volumes, due to "preflow" or to "afterflow" inherent in such supplying operations. Such preflow or afterflow may occur due to differences in compressibility of the two components, since most liquids will contain some amount of entrained air, thus making the liquids nonhydrostatic. Such preflow or afterflow is also likely to occur due to the fact that the two components are normally supplied by flexible hoses, and some degree of expansion and contraction of such hoses is unavoidable.

Accordingly, in the practical application of a static mixer of the interfacial surface generator type, it is often impossible to supply plural components to the interfacial surface generator without some interruption in the continuity of flow of the plural components. Unfortunately, this interruption of continuous flow is transmitted throughout the entire mixing operation of a conventional static mixer. The result is that there will be discharged from the mixer an outlet stream including a mixture of the fluid components, but such mixture will have therein solid patches or spots of the component corresponding to the initial patches or spots in the inlet stream. In other words, the solid patches will be passed entirely through the conventional static mixer and will appear in the finished product. Accordingly, in spite of the numerous potential advantages of static mixers of the interfacial surface generator type, the precise nature of such mixers, i.e. the maintenance throughout the mixer of predetermined fluid proportions, results in faults in the supply of the fluids being transmitted through the mixer and appearing in the finished product.

Such faults are unacceptable in many finished products. Thus, to eliminate such faults in operations which include the mixing of reactive multi-component materials, such as epoxies, polyesters, polyurethanes, silicones, etc., it has been necessary for industry to employ the use of dynamic mechanical mixers, which by their very nature will disperse solid patches of a single component. As indicated above however, conventional dynamic mechanical mixers have certain inherent cost and operational disadvantages, and it would still be desirable to industry to have a static mixer of the interfacial surface generator type which would avoid the above discussed faults occurring in the finished product, even when the component supply to the mixer is not ideally continuous.

SUMMARY OF THE INVENTION

With the above discussion in mind, it is a fundamental object of the present invention to provide a process and apparatus for statically mixing, by interfacial surface generator principles, plural fluid components while avoiding the above discussed inherent prior art disadvantages.

It is a further object of the present invention to provide a static mixing process and apparatus whereby it is possible to avoid the passage to the finished product of solid patches of one of the fluid components occurring in the inlet fluid stream, as a result of discontinuous supply of the components.

It is an even further object of the present invention to provide a static mixing process and apparatus whereby it is possible to ensure that any solid patches in the fluid inlet supply as a result of discontinuous supply of the components are progressively reduced in volume and blended into the mixture of the components during the mixing process within the novel phase blending interfacial surface generator type static mixer of the present invention.

The above objects are achieved in accordance with the present invention by the provision of a novel phase blending static mixer of the interfacial surface generator type including at least first and second separate chambers, and a plurality of passageways extending between and connecting the interiors of the first and second chambers. A fluid stream which is passed from the first chamber to the second chamber is divided by the plural passageways into separate plural substreams, and such plural substreams are recombined into a mixed main stream in the second chamber. The plural passageways are designed to have a configuration such that the substreams are longitudinally displaced relative to each other. Thus, upon recombination of the substreams into the main stream within the second chamber, the fluid of the separate substreams will be longitudinally dephased with respect to each other. More particularly, at least selected of the passageways are dimensioned such that the total resistances to flow of the fluid of the substreams passing through the selected passageways, from the beginnings thereof to the ends thereof, are unequal. This inequality of total resistance to flow may be achieved by providing that at least selected of the passageways have unequal transverse cross-sectional areas, or alternatively by providing that at least selected of the passageways have unequal lengths.

Accordingly, when the fluid inlet stream has therein solid patches of one of the fluid components, due to discontinuous supply of the components, as the components are passed in the separate substreams through the separate passageways, that portion of such solid patch in any given passageway will be longitudinally dephased with respect to the portions of the patch in the other passageways. Accordingly, when the substreams are recombined in the second chamber, the solid patch portions will not be brought back together and recombined, but rather will be longitudinally dephased with respect to each other.

Thus, when employing the concept of the present invention in an overall static mixer of the interfacial surface generator type including an inlet chamber, an outlet chamber, at least one recombination chamber positioned between the inlet and outlet chambers, and with all of the chambers being serially connected by stages of plural passageways, such that the fluid stream is successively divided plural times into plural substreams by each of the stages of plural passageways, and such that the plural substreams are reoriented and then recombined into a main stream in the chamber following each stage of plural passageways, then by providing that at least selected of the passageways of at least one stage are dimensioned such that the total resistances to flow of the fluid of the substreams passing through such slected passageways, from the beginnings thereof to the ends thereof, are unequal, it is possible to reduce the size of any solid patch of one component occurring in the fluid inlet stream which is supplied to the inlet chamber. More particularly, in such an overall static mixer system, it is possible to provide, not only a sufficient number of stages of plural passageways to achieve a desired degree of mixing of the components as is conventional in the art, but also by regulating the total resistances to flow of the fluids passing through the passageways of at least selected of the stages of passageways, it is possible to longitudinally dephase, to reduce the volume, and to blend any solid patch of one component into the mixture of components during the passage through the novel phase blending static mixer of the present invention.

Accordingly, in accordance with a further aspect of the present invention, there is provided in a static mixing process of the type wherein a fluid stream, including separate longitudinal layers of plural components, is mixed by dividing the fluid stream into a plurality of substreams, reorienting and recombining the substreams, and repeating such dividing, reorienting and recombining until a desired degree of mixing of the components is obtained, thereby forming an outlet stream in the form of a mixture of the components, and wherein the fluid stream contains periodic solid patches of one of the components, with the layer of the other component or components being interrupted by the solid patches, the improved process step of blending the solid patches into the mixture during the operations of repeated dividing, reorienting and recombining, and thereby preventing the solid patches from appearing in the outlet stream. The blending of the solid patches into the mixture is achieved by providing that at least selected of the substreams are longitudinally dephased with respect to each other, and this dephasing may be achieved by passing the substreams through passageways of unequal transverse cross-sectional area, or by passing the substreams through passageways of unequal length.

BRIEF DESCRIPTION OF THE DRAWINGS

Other objects, features and advantages of the present invention will become apparent from the following detailed description, taken with the accompanying drawings, wherein.

DETAILED DESCRIPTION OF THE INVENTION

It is to be understood that the accompanying drawings are intended to be schematic only and do not in any way attempt to accurately represent actual dimensions of the various machines involved. It is further to be understood that various conventional features of the static mixer art have not been included in the present drawings for purposes of clarity of illustration, and inasmuch as such conventional features are unnecessary for an illustration and explanation of the novel features of the present invention.

Figure 1:
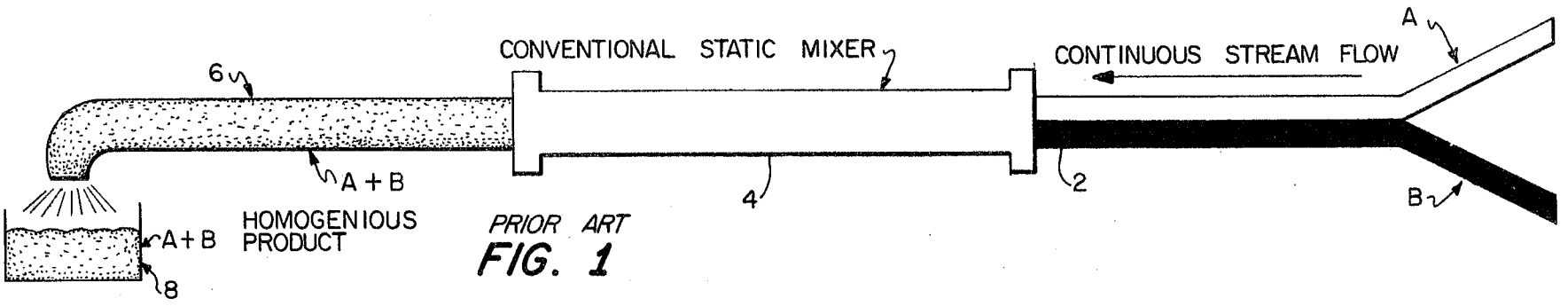
PRIOR ART FIG. 1
FIG. 1 is an abbreviated schematic flow chart illustrating the mixing of two components supplied in a continuous stream flow with the use of a conventional static mixer of the interfacial surface generator type.
Figure 2:
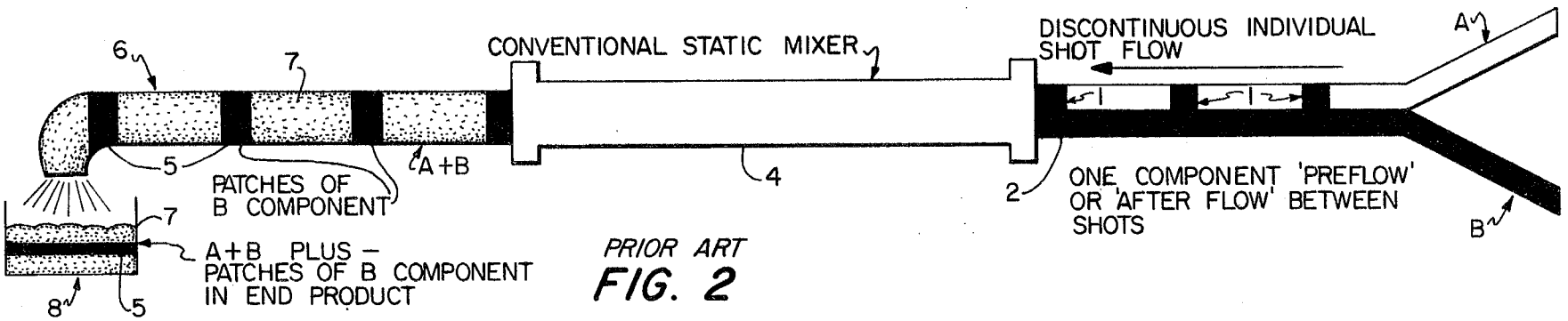
PRIOR ART FIG. 2
FIG. 2 is a flow chart similar to FIG. 1, but illustrating that when the supply of one of the components is discontinuous, the resultant finished product will have a defect formed by a patch or spot of such component.
Figure 3:
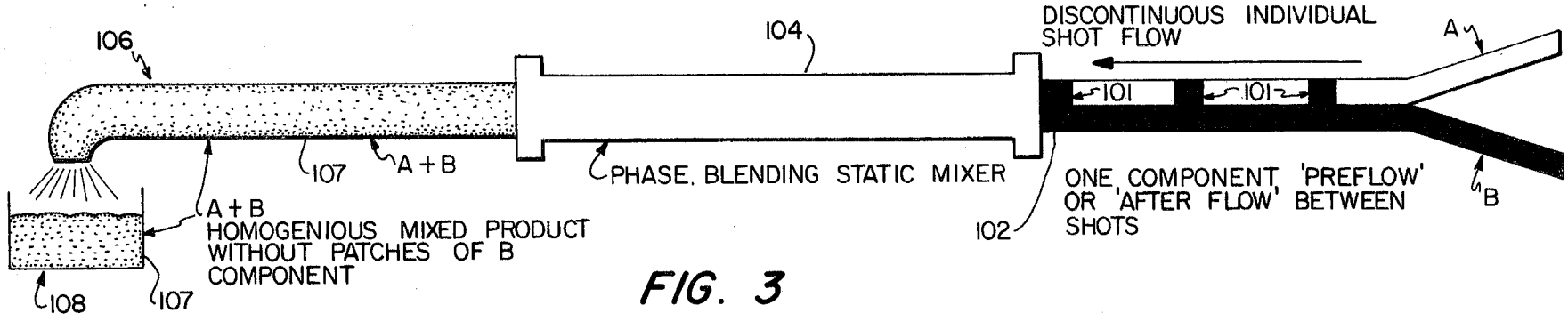
FIG. 3 is a flow chart similar to FIGS. 1 and 2, but illustrating that when employing the novel phase blending static mixer of the present invention, even though the supply of the components is discontinuous, the resultant finished product will be a completely homogeneous mixture, without the presence therein of any patches or spots of one of the components.

Reference will initially be made to FIGS. 1 through 3 of the drawings which schematically illustrate an inherent disadvantage of conventional static mixers of the interfacial surface generator type.

More particularly, there is schematically shown in FIG. 1 a conventional interfactial surface generator mixing system wherein a fluid stream 2, composed of separate layers of components A and B, is continuously supplied to a conventional static mixer 4 of the interfacial surface generator type. Conventional mixer 4 divides the fluid stream 2 into a plural number, for example four, substreams, then twists and reorients the substreams, and then recombines the substreams into a main stream. This operation is repeated a plurality of times, depending on the particular components involved, until the different fluid components A and B are thoroughly mixed to form a discharge stream 6 having a homogeneous mixture of A+B. The discharge stream 6 is then supplied or emptied in a known manner to form a completely homogeneous product 8 formed of the homogeneous mixture A+B.

The above discussion and FIG. 1 are directed to the theoretical ideal operation of a conventional static mixer of the interfacial surface generator type, i.e. when the supply of components A and B is in fact continuous and always proportional.

However, the ideal operation illustrated in FIG. 1 is substantially impossible to achieve, and the operation that is in fact normally achieved by conventional static mixers is illustrated in FIG. 2. More particularly, when supplying components A and B to static mixer 4, it is in fact normally not possible to achieve entirely continuous flow. Rather, what normally occurs is that the proportion of components A and B is temporarily interrupted such that stream 2 is not formed by two continuous layers, but rather one of the layers will be intermittently interrupted by the other layer, such that at spaced positions along the stream 2 there will occur solid patches or spots of only one component. This is illustrated in FIG. 2 of the drawings wherein the stream 2 includes spaced patches or spots 1 of only component B. Thus, the supply of component A is shown as being discontinuous.

Such discontinuous supply may be caused due to the pulsation of the pumps employed to supply the components when attempting to supply the components continuously. Such discontinuous flow is also unavoidable when the components are supplied when discharging shot volumes, due to "preflow" or to "afterflow" inherent in supplying the fluids by discharging volumes. Such preflow or afterflow may occur due to differences in compressibility of the two components, since most liquids will contain some amount of entrained air, thus making the liquids non-hydrostatic. Such preflow or afterflow is also likely to occur due to the fact that the two components are normally supplied by flexible hoses, and some degree of expansion and contraction of such hoses is unavoidable.

Thus, in practical application of a static mixer, it is virtually impossible to supply plural components to the static mixer without some interruption in the continuity of flow of the two components.

This interruption of continuous flow, represented by solid patches 1 of a single component in inlet stream 2, is unfortunately transmitted throughout the entire mixing operation of a conventional static mixer. The result is that the discharge stream 6 will include portions 7 of a homogeneous mixture A+B, but will have therein patches or spots 5 of the component B corresponding to the initial patches 1 in the inlet stream 2. Thus, these solid patches of one component, i.e. component B in the illustrated arrangement, will pass entirely through the static mixer and will appear in the finished product B.

The manner in which the solid patches of single component are passed entirely through the static mixer will now be discussed with reference to FIG. 4 of the drawings.

As will be well understood by those conversant in the art, conventional static mixer 4 of the interfacial surface generator type includes an inlet chamber 10 into which the inlet or feed stream 2 is supplied, an outlet chamber 50 from which the outlet stream 6 is discharged, and a plurality of interfacial surface generator units positioned between inlet chamber 10 and outlet chamber 50. An interfacial surface generator unit includes plural passageways or conduits which divide the inlet stream into plural substreams, each substream including a layer of each of the components. The substreams are then normally twisted and reoriented and then supplied to a chamber wherein the substreams are recombined into a main stream. This main stream is then again subdivided into plural substreams, each new substream being further divided into plural layers of each of the components, and these new substreams are again then recombined. This operation is repeated a plurality of times as necessary, dependent upon the components involved and the desired degree of mixture thereof.

Figure 4:
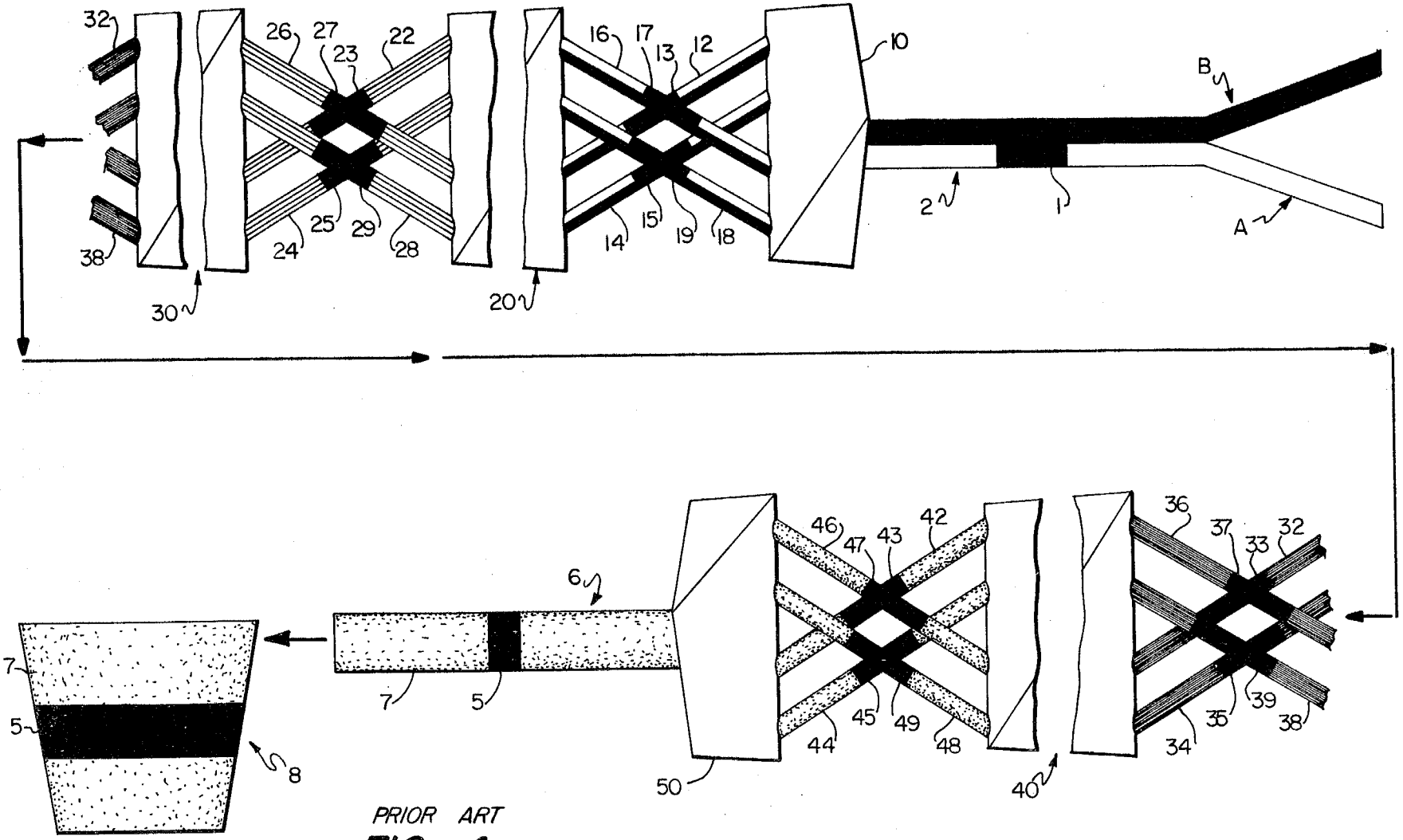
PRIOR ART FIG. 4
FIG. 4 is a somewhat expanded schematic flow chart similar to FIG. 2, but schematically illustrating the passage of the components through the various stages of the conventional static mixer and illustrating how an out of phase portion of the components is transmitted throughout the entire static mixer to result in a patch or spot of one of the components appearing in the finished product.

In FIG. 4 there are illustrated four passageways extending from inlet chamber 10, each passageway including a substream, 12, 14, 16 and 18, respectively, each of which includes a layer of component A and component B. The passageways are aligned to twist and reorient the substreams, and the substreams are then introduced into a recombination chamber 20 wherein the substreams 12, 14, 16 and 18 are joined into a main stream. The main stream is then again divided by four passageways into new substreams 22, 24, 26 and 28, each of which is now divided into plural layers of each of components A and B. These substreams are then supplied into a further recombination chamber 30. This process is repeated a plurality of times, foring further substreams 32, 34, 36 and 38 which are rejoined in chamber 40, again forming plural substreams 42, 44, 46 and 48 which are discharged into outlet chamber 50.

It is to be understood that all of the structural features and orientations of the various elements of the conventional static mixer have not been illustrated in FIG. 4. Such features would be well understood by those skilled in the art. Generally however, the type of static mixer illustrated in FIG. 4 is of the type referred to as a "4×4" mixer wherein eight component layers are discharged into chamber 20, thirty-two component layers are discharged into chamber 30, one hundred twenty-eight component layers are discharged into chamber 40, etc.

It will be apparent from FIG. 4 of the drawings that solid patch 1 of component B which occurs in inlet stream 2 is passed through the conventional static mixer so that it emerges substantially intact in discharge stream 6 and in finished product 8. This is due to the fact that in conventional static mixers of this type, the total resistance to flow of the fluid in each substream, from the beginning to the end of the respective substream passageway, is equal to the total resistance to flow of the fluids of the other substreams, from the beginnings to the ends of the respective substream passageways, of a given interfacial surface generator unit. That is, the total resistance to flow of the fluid in substream 12, from the beginning to the end of the passageway for substream 12, is equal to the total resistance to flow of the fluids in each of substreams 14, 16 and 18, from the beginnings to the ends of the respective passageways for substreams 14, 16 and 18. Therefore, when substreams 12, 14, 16 and 18 are discharged into chamber 20, the relative positions of patches 13, 15, 17 and 19 thereof remain constant with respect to each other. Thus, when further divided substreams 22, 24, 26 and 28 pass out of chamber 20 and toward chamber 30, the solid patches of component B will still be in phase with each other and will be rejoined to each other to form patches 23, 25, 27 and 29 in substreams 22, 24, 26 and 28, respectively. Similarly, these patches will remain in phase with respect to each other in chamber 30 and will be rejoined to form solid patches of component B as at 33, 35, 37 and 29 in substreams 32, 34, 36 and 38, respectively, passing into chamber 40. Further similarly, patches 33, 35, 37 and 39 will remain in phase with respect to each other while in chamber 40, and when substreams 42, 44, 46 and 48 pass from chamber 40 to outlet chamber 50, these solid patches of component B will again be rejoined to form solid patches 43, 45, 47 and 49, respectively. Thus, the mixed stream 6 which is discharged from outlet chamber 50 and which is supplied to finished product 8, will have therein, not only portions 7 formed of a homogeneous mixture of components A and B, but also patches or spots 5 which are entirely formed of component B.

It is believed to be apparent from the above discussion with regard to FIG. 4, that the unavoidable solid portions of one component which are supplied to a conventional static mixer of the interfacial surface generator type are automatically transmitted throughout the static mixer and unavoidably are present in the finished product. This phenomenon is clearly undesirable, inasmuch as the solid patch or spot of component B will appear as a fault in the finished product.

Research by the applicant has determined that the occurrence of the undesirable patch or spot 5 of one component in the finished product 8 is due to the arrangement illustrated in FIG. 4, i.e. that the solid patch 1 is unavoidably and automatically passed through a conventional static mixer. Applicant has further determined that this phenomenon is apparently due to the above discussed fact that, at any stage within the static mixer, the total resistances to flow of the layers passing through the plural substream passageways are equal. That is, the total resistances to flow of substreams 12, 14, 16 and 18 are equal, the total resistances to flow of substreams 22, 24, 26 and 28 are equal, etc. Thus, it is unavoidable that the solid spot or patch 1 of component B in the inlet stream 2 be automatically transferred to finished product 8 as patch or spot 5 of component B.

As a result of this discovery, applicant has determined that the occurrence of the solid patch of one component in the finished product can be entirely avoided by modifying the conventional static mixer of the interfacial surface generator type to sequentially blend or dephase such solid spot throughout the mixer. More particularly, this is done by providing that at least some of the plural substream passageways in at least one stage of the static mixer are dimensioned such that the total resistance to flow of the fluids of the substreams passing through such passageways are unequal.

Thus, and with reference to FIG. 3 of the drawings, an inlet stream 102 includes layers of different components A and B. Inlet stream 102 unavoidably, for the reasons discussed above, has therein solid patches or spots 101 of only one component, i.e. of component B in the illustrated arrangement. Inlet stream 102 is passed into the improved phase blending static mixer 104 of the present invention, and therein not only are the two components A and B mixed to form outlet stream 106 of a homogeneous mixture 107 of components A+B, but also the solid portions 101 of only one component are sequentially dephased and blended into the overall mixture.

Figure 5:
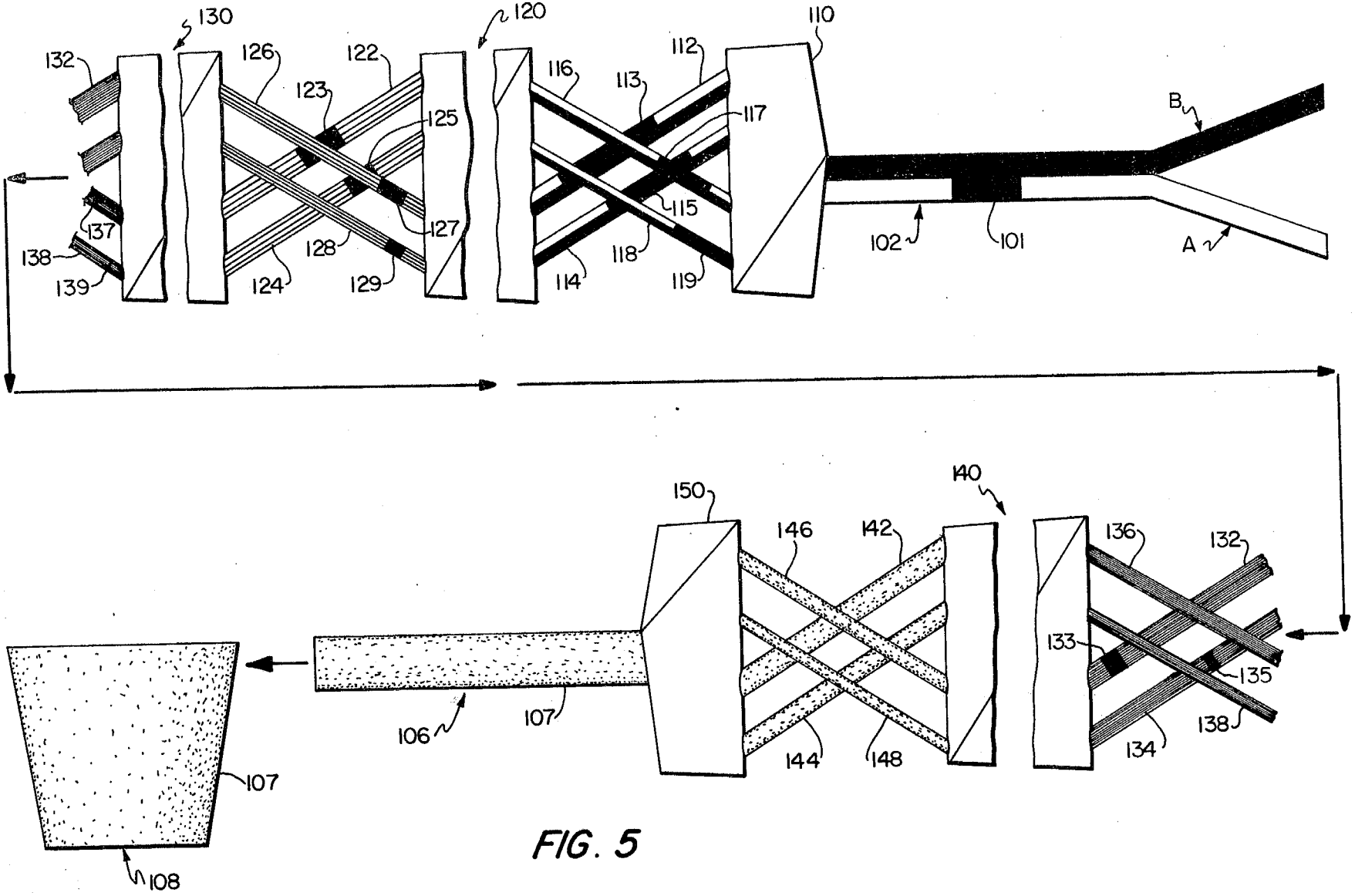
FIG. 5 is a flow chart similar to FIG. 4, but illustrating how the improved phase blending static mixer in accordance with one embodiment of the present invention sequentially disperses the out of phase component portion throughout the entire mixing length, to thereby prevent the occurrence of a patch or spot of the component in the finished product.

The manner of achieving the above results in accordance with a preferred embodiment of the present invention is illustrated in FIG. 5 of the drawings. Specifically, inlet stream 102, including layers of components A and B, is supplied into inlet chamber 110. The inlet stream is then divided by four passageways to form substreams 112, 114 116 and 118, each substream having a layer of component A and a layer of component B. Further, each substream 112, 114, 116 and 118 will have therein a solid portion 113, 115, 117 and 119, respectively, of the solid patch 101 from inlet stream 102.

However, in accordance with the present invention, the total resistances to flow of the fluids of at least some of the substreams 112, 114, 116 and 118, within the respective passageways, are made different. In accordance with the embodiment illustrated in FIG. 5, this difference in total resistance to flow through the substream passageways is achieved by providing that the passageways through which the substreams pass are of different cross-sectional areas, e.g. different diameters. That is, the passageway for substream 112 is the largest, the passageway for substream 114 is smaller, the passageway for substream 116 is even further smaller, and the passageway for substream 118 is still further smaller. It is believed that this size relationship will be apparent from FIG. 5 of the drawings. Thus, since the transverse cross-sectional areas of the passageways for the plural substreams are different, the total resistance to flow of each of the substreams passing through the respective passageways will be different. Therefore, the patches 113, 115, 117 and 119 will be progressively dephased from each other with regard to the general direction of passage through the mixer. Even further, due to the successively smaller sizes of substreams 112, 114, 116 and 118, the total volumes of the patches 113, 115, 117 and 119, respectively, will be successively reduced.

The substreams 112, 114, 116 and 118 are then rejoined in chamber 120, from which further substreams 122, 124, 126 and 128, each containing additional plural layers of components A and B, emerge. In each of additional substreams 122, 124, 126 and 128, the solid patches of component B will be rejoined, to thereby form solid patches 123, 125, 127 and 129, respectively. However, the passageways forming substreams 122, 124, 126 and 128 are again of different and respectively reduced cross-sectional areas. Thus, the total resistance to flow of the fluid of these substreams through the respective passageways will be different, i.e. the total resistance to flow of substream 122 will be the least, and the total resistance to flow of substream 128 will be the greatest. Thus, the solid patches 123, 125, 127 and 129 are further dephased from each other in the longitudinal direction of passage of the components through the mixer. Yet further, due to the differences in sizes of the passageways through which the substreams pass, the respective volumes of the solid portions of component B which are rejoined to form patches 123, 125, 127 and 129 are again successively reduced.

This operation is repeated as necessary, with the solid patches of component B being successively spread out or dispersed longitudinally of the mixing direction. This is due to the fact that as the layers are redivided and passed through successive stages of the mixer, the differences in resistance to flow of the substreams in a given stage of the mixer cause a longitudinal dephasing of the solid portions, and due to the fact that the differences in cross-sectional areas of the substreams in a given stage of the mixer result in a progressive and longitudinal reduction in volume of the solid patches. It is believed that this is clearly apparent from substreams 132, 134, 136 and 138, which pass from chambers 130 to 140, wherein the respective solid portions 133, 135, 137 and 139 are obviously and clearly longitudinally dephased with respect to each other and are of successively reduced volume with respect to each other.

Accordingly, by this longitudinal displacement and successive reduction in volume of the sizes of the solid portions of component B, such solid portions are gradually blended into the normal homogeneous mixture of components A and B. Accordingly, the substreams 142, 144, 146 and 148 which are discharged into outlet chamber 150 and which then pass therefrom as outlet stream 106, form an entirely homogeneous mixture of components A+B, without the presence therein or in finished product 108 of any solid patch or spot of component B.

FIG. 5 illustrates a preferred embodiment of the present invention wherein the difference in resistance to flow of the substreams at a given stage of the static mixer is achieved by providing that the passageways for the substreams be of different cross-sectional area. In accordance with this embodiment, the actual flow rates of the substreams of a given stage of the mixer, in any plane extending through the substreams and transverse to the longitudinal direction of the mixer, are different.

However, it is possible in accordance with a further embodiment of the present invention to provide different total resistances to flow of the substreams at a given stage of the static mixer by providing that the passageways for the substreams of a given stage of the mixer be of different length. This embodiment of the present invention is illustrated in FIG. 6.

Figure 6:
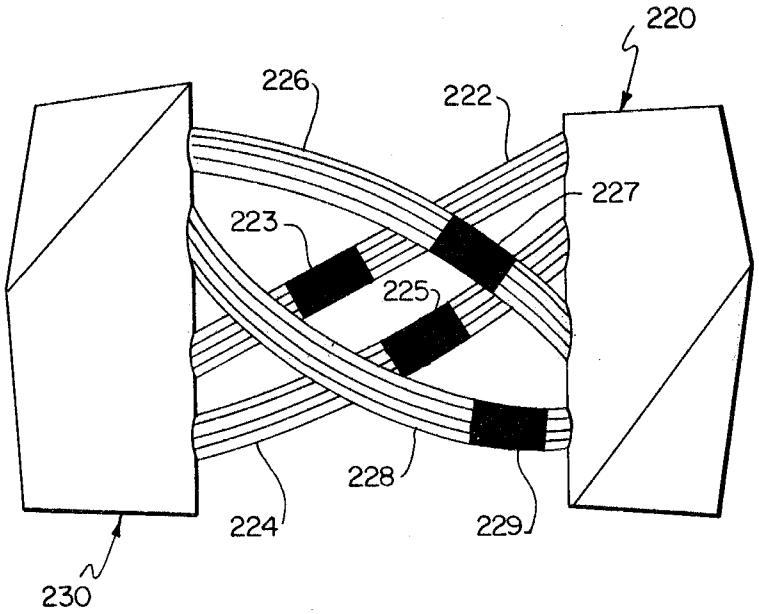
FIG. 6 is a partial schematic flow chart similar to FIG. 5, but illustrating a second embodiment of the present invention.

Thus, in FIG. 6 there are shown chambers 220 and 230, between which pass substreams 222, 224, 226 and 228, each including plural layers of different liquid components. The initial inlet stream (not shown) includes therein a solid portion of one of the components, for reasons discussed above. When the substreams 222, 224, 226 and 228 exit from chamber 220, the solid component portions are rejoined to form patches 223, 225, 227 and 229. In this embodiment, the cross-sectional areas of the passageways for the substreams are the same. However, the lengths of the passageways for substreams 222, 224, 226 and 228 are successively different. Thus, the passageway for substream 222 is the shortest, the passageway for substream 224 is longer than the passageway for substream 222, the passageway for substream 226 is longer than the passageway for substream 224, and the passageway for substream 228 is longer than the passageway for substream 226. Therefore, the overall resistance to flow encountered by each of the substreams during their respective flows from chamber 220 to chamber 230 will be different, and the solid patches 223, 225, 227 and 229 will respectively become out of phase from each other in the longitudinal direction of passage through the mixer. That is, upon discharge of the patches into chamber 230, the relative positions of the patches in the longitudinal direction of the mixer will be further displaced as a function of the differences in total length (i.e. total resistance to flow) of the respective passageways. More particularly, patch 225 will take longer than patch 223 to reach chamber 230, since the passageway of substream 224 is longer than the passageway of substream 222. Thus, in chamber 230 patch 225 will be further longitudinally displaced with respect to patch 223 than is shown in FIG. 6. Similarly, in chamber 230 patch 227 will be further longitudinally displaced with respect to patch 225 than is shown in FIG. 6, etc. It will become apparent that this phenomenon will be progressively amplified through successive stages of the mixer. It will further be apparent that the volumes of the solid patches occurring in the substreams of successive stages of the mixer will be reduced as such patches are progressively blended into the other fluid layers.

In FIG. 5 of the drawings it is shown that all of the passageways at a given stage within the mixer are of different cross-sectional sizes. It is to be understood however that it is intended that the scope of the present invention encompass arrangements where only some of the passageways at a given stage within the mixer have different cross-sectional areas. Similarly, in the arrangement of FIG. 6, it is to be understood that the scope of the present invention encompasses arrangements where only some of the substreams of a given stage within the mixer have different lengths. Even further, and with regard to both FIGS. 5 and 6, it is to be understood that the scope of the present invention includes an arrangement where only one of the stages, or any number less than all of the stages, of the mixer is designed to achieve the above discussed difference in total resistance to flow of the substreams at a given stage.

Additionally, although the present invention is discussed above with regard to a 4×4 type mixer, it is to be understood that the concept of the present invention is equally applicable to other known types of static mixers wherein all or any of the stages may include a lesser or a greater number of substreams. Yet further, it is to be understood that although FIG. 5 illustrates four stages or subdivision into substreams, the scope of the present invention is intended to be employed with a lesser or a greater number of stages, depending upon the components involved and the desired degree of homogeneity of the finished product.

Furthermore, it is not intended to limit the scope of the present invention to any specific proportions regarding relative cross-sectional size of substreams or relative longitudinal length of substreams. Such parameters would vary greatly, as will be readily apparent to one of ordinary skill in the art upon considering the present disclosure, dependent upon a number of factors, including the components involved, the capability of the system supplying the components to the static mixer, the degree of homogeneity desired in the finished product, and other factors.

It has however been found in one actual use of the embodiment of FIG. 5 of the present invention that in a 4×4 type mixer, each stage had four substreams defined by passages sized such that the volumes of the respective substreams were successively reduced from 100%, to 85.4%, to 66.6%, and to 50%. That is, and with reference to FIG. 5 of the drawings, the total volume of substream 114 was 85.4% of the total volume of substream 112, the total volume of substream 116 was 66.6% of the total volume of substream 112, and the total volume of substream 118 was 50% of the total volume of substream 112.

One factor that would of course have to be taken into consideration when employing certain materials of the "gelling" or "setting up" type, is that the total resistance to flow of any given substream must not be increased by an amount which would create gelling or setting up within the mixer. It is believed however that those conversant in the art would readily understand how to design a given mixer to control such undesirable occurrence.

It is further to be understood that the scope of the present invention is not limited to any particular configuration of the elements of the static mixer. Thus, the chambers 110, 120, etc. can be of any configuration which is conventional in the interfacial surface generator mixer art. A configuration of the chambers which is commercially preferable is that of a tetrahedron, to thereby provide minimum material hang up within the chambers. Further, the cross-sections of the passageways forming the various substreams may be circular, rectangular, or any other conventional configuration. Additionally, the concept of the present invention may be employed in an interfacial surface generator of the type wherein the passageways for the substreams are provided as bores through solid blocks, the ends of which define the chambers, or alternatively the passageways for the substreams may be in the form of pipes or conduits extending between hollow bodies which form the chambers. It is intended that the present invention be applicable with static mixers of these or other known and conventional configurations. Further, the paths and orientations of the various substreams have been somewhat simplified in the drawings for the purpose of clarity of illustration. It is specifically to be understood that any configuration and orientation of the passageways which is conventionally employed to reorient and mix the components is intended to be applicable with the novel features of the present invention.

Further, it is intended that the scope of the present invention include an arrangement such that differences in resistance to flow of the substreams of a given stage of the mixer be achieved by a combination of the principles of the embodiments of FIGS. 5 and 6. That is, at least some of the passageways for the substreams of a given stage of the mixer could have both unequal cross-sectional areas and unequal lengths.

Additionally, it is to be understood that as employed in this description and in the appended claims, the term "mixture" is intended to refer, not only to actual physical mixtures, but also to compounds formed as a result of chemical reactions occurring when blending together components which are reactive to each other.

Other modifications to the above described and illustrated procedures and structural arrangements will be apparent to those skilled in the art, and it is intended that such modifications be encompassed within the scope of the present invention.

What I claim is:

1. In a static mixer of the interfacial surface generator type for mixing plural viscous reactive components and including an inlet chamber, means for supplying into said inlet chamber a fluid stream including separate longitudinal layers of plural viscous reactive components, an outlet chamber from which is discharged an outlet stream in the form of a viscous mixture of said plural components, at least one recombination chamber positioned between said inlet and outlet chamber, all of said chambers being serially connected by stages of plural separate passageways, such that said fluid stream is successively divided into plural separate substreams by each of said stages of plural passageways, and said plural substreams are reoriented and then recombined into a main stream in the said chamber following each said stage of plural passageways, whereby said plural components are successively mixed to form said mixture, and wherein said fluid stream supplied to said inlet chamber contains periodic solid patches of one of said components, with the layer of the other component being interrupted by said solid patches, the improvement comprising:

means for blending said solid patches into said mixture and for thereby preventing said patches from appearing in said outlet stream, said blending means comprising at least selected of said separate passageways of at least one of said stages having unequal transverse cross-sectional areas, such that the total resistances to flow of the fluid of the substreams passing through said selected passageways, from the beginnings thereof to the ends thereof, are unequal.

2. The improvement claimed in claim 1, wherein all of said separate passageways of each said stage have unequal transverse cross-sectional areas.

3. The improvement claimed in claim 1, wherein said selected passageways have equal lengths.

4. The improvement claimed in claim 1, wherein all of said separate passageways of each said stage join the respective following chamber at the same longitudinal position thereof, taken in the direction of flow of said components through the mixer, such that said separate plural substreams are simultaneously recombined into said main stream at said same longitudinal position.

5. In a static mixing process for mixing plural viscous reactive components, said process comprising mixing a fluid stream, including separate longitudinal layers of plural viscous reactive components, by dividing said fluid stream into a plurality of separate substreams, reorienting and recombining said substreams, and repeating such dividing, reorienting and recombining until a desired degree of mixing of said plural viscous reactive components is obtained, thereby forming an outlet stream in the form of a viscous mixture of said components, and wherein said fluid stream contains periodic solid patches of one of said components, with the layer of the other component being interrupted by said solid patches, the improvement comprising:

blending said solid patches into said mixture during said repeated dividing, reorienting and recombining, thereby preventing said solid patches from appearing in said outlet stream, said blending comprising passing at least selected of said separate substreams through separate passageways of unequal transverse cross-sectional area.

6. The improvement claimed in claim 5, comprising passing all of said separate substreams through separate passageways of unequal transverse cross-sectional area.

7. The improvement claimed in claim 5, wherein each said step of reorienting and recombining comprises releasing said separate substreams from said separate passageways at the same longitudinal position, taken in the direction of movement of said fluid stream.

* * * * *

UNITED STATES PATENT AND TRADEMARK OFFICE

CERTIFICATE OF CORRECTION

PATENT NO. : 4,198,168

DATED : April 15, 1980

INVENTOR(S) : Laurence R. Penn

It is certified that error appears in the above-identified patent and that said Letters Patent are hereby corrected as shown below:

In the title: delete "STATIC".

Column 1, line 1, delete "STATIC";
line 7, delete "statically";
line 9, delete "static";
line 11, delete "static or";
line 23, delete "static or";
line 27, delete "static or";
line 31, delete "static";
line 60, delete "static";
line 67, delete "static".

Column 2, line 5, delete "static";
line 7, delete "static";
line 24, delete "static";
line 34, delete "statically";
line 39, delete "static";
line 45, delete "static";
line 51, delete "static";
line 55, delete "static".

UNITED STATES PATENT AND TRADEMARK OFFICE

CERTIFICATE OF CORRECTION

PATENT NO. : 4,198,168

DATED : April 15, 1980

INVENTOR(S) : Laurence R. Penn

It is certified that error appears in the above-identified patent and that said Letters Patent are hereby corrected as shown below:

Column 3, line 24, delete "static";
line 42, delete "static";
line 55, delete "static".

Column 4, line 20, delete "static";
line 27, delete "static";
line 35, delete "static";
line 37, d lete "static";
line 41, delete "static";
line 58, delete "static";
line 65, delete "static".

Column 5, line 3, delete "static";
line 17, delete "static";
line 23, delete "static";
line 25, delete "static";
line 54, delete "static";
line 56, delete "static";
line 61, delete "static";
line 68, delete "static".

UNITED STATES PATENT AND TRADEMARK OFFICE

CERTIFICATE OF CORRECTION

PATENT NO. : 4,198,168

DATED : April 15, 1980

INVENTOR(S) : Laurence R. Penn

It is certified that error appears in the above-identified patent and that said Letters Patent are hereby corrected as shown below:

Column 6, line 2, delete "static";
line 6, delete "static";
line 38, change "foring" to --forming--;
line 44, delete "static";
line 46, delete "static";
line 55, delete "static";
line 58, delete "static".

Column 7, line 30, delete "static";
line 32, delete "static";
line 41, delete "static";
line 43, delete "static";
line 55, delete "static";
line 60, delete "static".

Column 8, line 1, delete "static".

Column 9, line 27, delete "static";
line 37, delete "static".

Column 10, line 37, delete "static";
line 54, delete "static".

UNITED STATES PATENT AND TRADEMARK OFFICE

CERTIFICATE OF CORRECTION

PATENT NO. : 4,198,168 Page 4 of 4

DATED : April 15, 1980

INVENTOR(S) : Laurence R. Penn

It is certified that error appears in the above-identified patent and that said Letters Patent are hereby corrected as shown below:

Column 11, line 12, delete "static";
line 29, delete "static";
line 58, delete "static".

Column 12, line 37, delete "static".

Signed and Sealed this

*Twelfth* Day of *January 1982*

[SEAL]

*Attest:*

GERALD J. MOSSINGHOFF

*Attesting Officer* *Commissioner of Patents and Trademarks*